United States Patent [19]

Bourne et al.

[11] Patent Number: 4,645,261

[45] Date of Patent: Feb. 24, 1987

[54] CHILD'S CONVERTIBLE FURNITURE

[76] Inventors: Richard Bourne; Carol Bourne, both of 1226 Villanova Dr., Davis, Calif. 95616

[21] Appl. No.: 777,547

[22] Filed: Sep. 19, 1985

[51] Int. Cl.[4] ..... A47C 13/00

[52] U.S. Cl. ..... 297/118; 297/119; 297/130; 297/440

[58] Field of Search ..... 297/118, 119, 130, 134, 297/440

[56] References Cited

U.S. PATENT DOCUMENTS

| | | | |
|---|---|---|---|
| 2,749,971 | 6/1956 | Ehrman | 297/119 |
| 2,982,562 | 5/1961 | Gladstein | 297/130 X |
| 3,352,602 | 11/1967 | Svendsen | 297/130 |
| 4,036,523 | 7/1977 | Nielsen | 297/130 |
| 4,092,032 | 5/1978 | Pittas | 297/440 |

*Primary Examiner*—Francis K. Zugel
*Attorney, Agent, or Firm*—Parkhurst & Oliff

[57] ABSTRACT

The invention relates to a child's convertible furniture set which includes a base, a seat, and a desk top. The seat and desk top include dowel pins and notches which interlock with mating slots and dowel rods, respectively, in the base so that screws, bolts or other securing devices are not required to assemble the furniture or convert it from one configuration to another. The seat and base can be combined to form a low chair, a high chair capable of four different heights, a table chair capable of four positions, and an angled chair capable of two positions. The desk top and base can be combined to create a writing desk. The seat can be suspended by itself to form a swing, and the base can be used alone as a stepstool.

19 Claims, 12 Drawing Figures

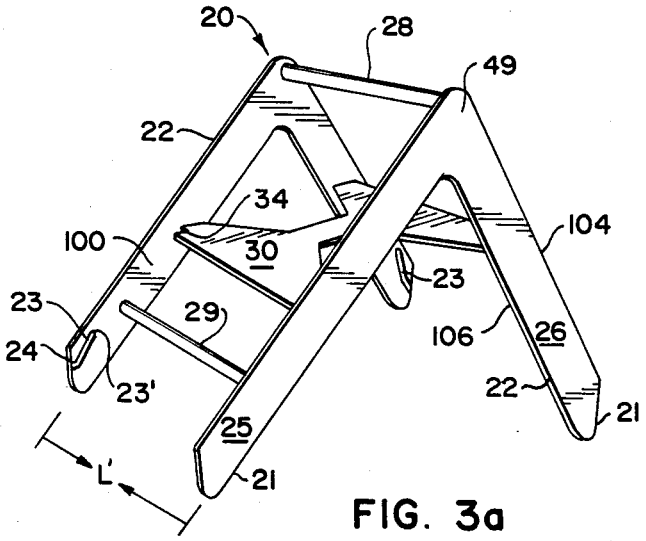
FIG. 3a
FIG. 3b
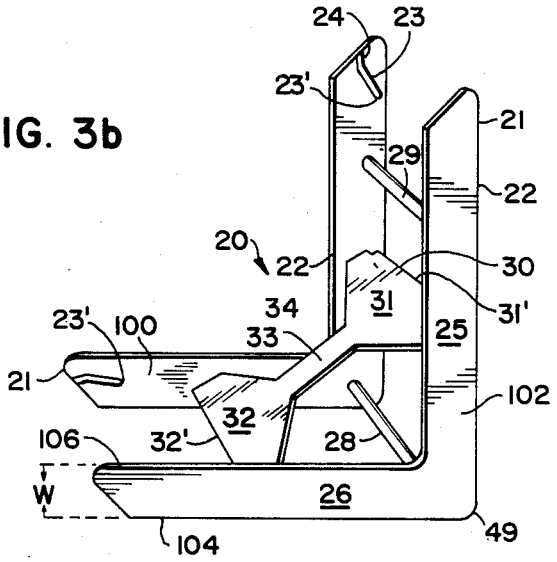

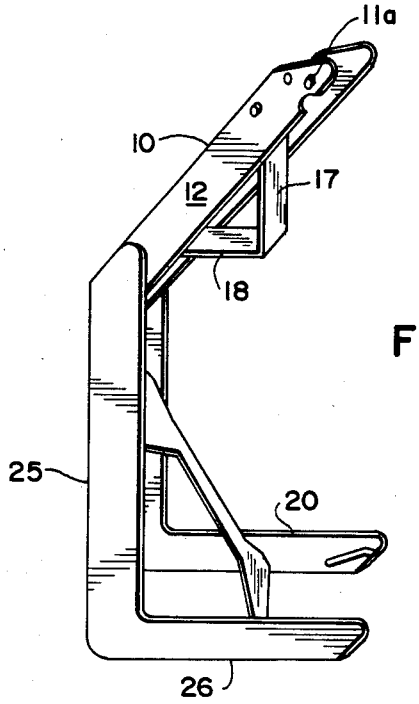
FIG. 4b
FIG. 5
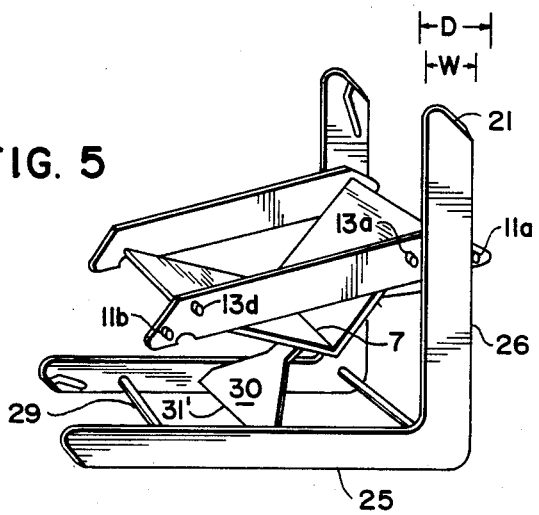

FIG. 7a
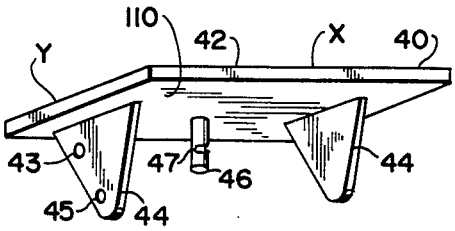
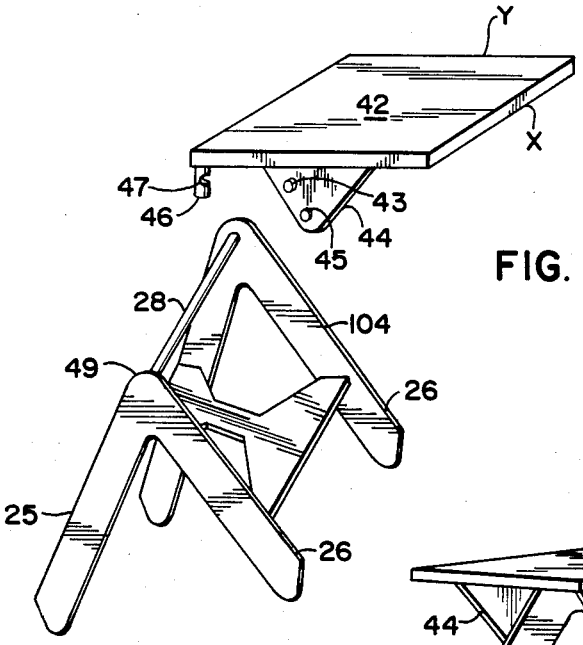
FIG. 7b
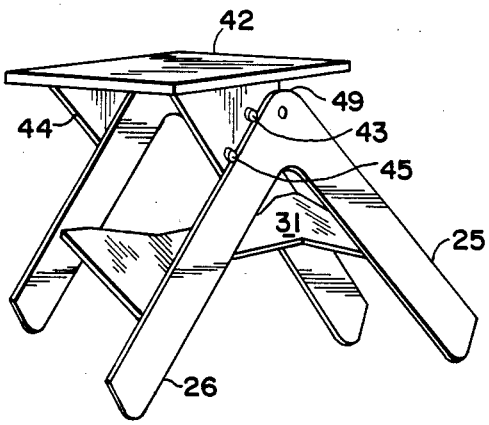
FIG. 8

CHILD'S CONVERTIBLE FURNITURE

BACKGROUND AND SUMMARY OF THE INVENTION

The present invention relates to items of furniture adaptable or convertible to more than one use. More particularly, the invention relates to a child's convertible furniture set which includes three pieces that are combined to form a low chair, an angled chair capable of two positions, a table chair capable of four positions, a high chair capable of four positions, a swing, a writing desk, and a stepstool.

The prior art discloses a number of items of convertible furniture for children, all of which suffer from one or more of the following drawbacks: relatively high expense; bulky or unattractive appearance; small number of possible configurations; use of a large number of parts requiring time and tools to convert from one configuration to another; difficulty in conversion; and difficulty in adjusting for the heights of different children, or one child as that child grows. All of these failings detract from the usefulness of a piece of furniture and tend to defeat the original purpose of convertible furniture i.e., versatility, simplicity and economy of price and time.

Accordingly, the purpose of this invention is to provide a child's convertible furniture set having three elements which provide versatility, simplicity and economy.

It is a further object of the invention to provide a set of child's convertible furniture which is converted to seven different types of furniture positions: a highchair (adjustable in height to four levels), a low chair, a table chair (adjustable to four positions), an angled chair (adjustable in height to two levels), a swing, a writing desk and a step stool.

It is a further object of this invention to provide a set of convertible furniture that is quickly converted from one position to another without tools or hardware, simply by combining two of three basic elements.

Another object of the present invention is to provide a convertible furniture set which requires no adjustment or tightening of nuts or bolts and no additional tools, equipment or hardware for assembly or conversion.

It is another object of the present invention to provide a convertible furniture set having components that are simply fitted together using pins mating with slots or rods mating with notches to convert from one configuration to the next in a matter of seconds.

It is a still further object of this invention to provide a set of child's convertible furniture that is adjustable in height.

It is yet a further object of this invention to provide a set of child's furniture that is inexpensive and has an aesthetically pleasing design.

To achieve this and other objects and advantages, the invention relates to a child's convertible furniture set which includes a base, a seat, and a desk top. The seat and desk top include dowel pins and notches which interlock with mating slots and dowel rods, respectively, in the base so that screws, bolts or other securing devices are not required to assemble the furniture or convert it from one configuration to another. The slot and base can be combined to form a low chair, a high chair (capable of four different heights), a table chair (capable of four positions), and an angled chair (capable of two positions). The desk top and base can be combined to create a writing desk. The seat can be suspended by itself to form a swing, and the base can be used alone as a stepstool.

BRIEF DESCRIPTION OF THE DRAWINGS

The present invention will be described in detail herein in conjunction with the appended drawings in which like elements bear like reference numerals, and wherein:

FIG. 3*a* is a perspective view of the base element of FIG. 1, in the stepstool configuration;

FIG. 3*b* is a perspective view of the base element in an alternative position for assembly into the highchair or table chair configuration;

FIG. 4*b* is a perspective view of the tall highchair configuration;

FIG. 5 is a perspective view of the angled table chair configuration;

FIG. 7*a* is a perspective view of the desk top element of the instant invention;

FIG. 7*b* is a perspective view of the desk top element of FIG. 7*a* during assembly to the base of FIG. 3*a;*

FIG. 8 is a perspective view of the desk configuration; and

DETAILED DESCRIPTION OF THE INVENTION

Figure 1:
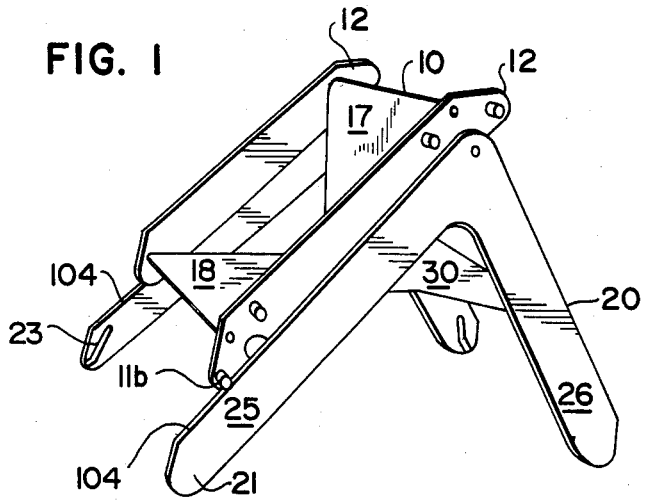
FIG. 1 is a perspective view of the convertible furniture in accordance with the invention illustrating it in a low chair configuration.
Figure 6:
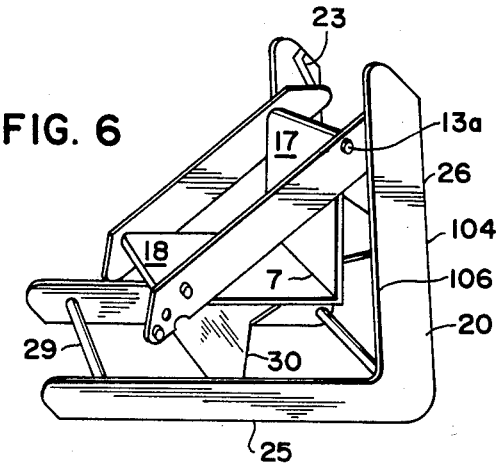
FIG. 6 is a perspective view of the level table chair configuration.
Figure 9:
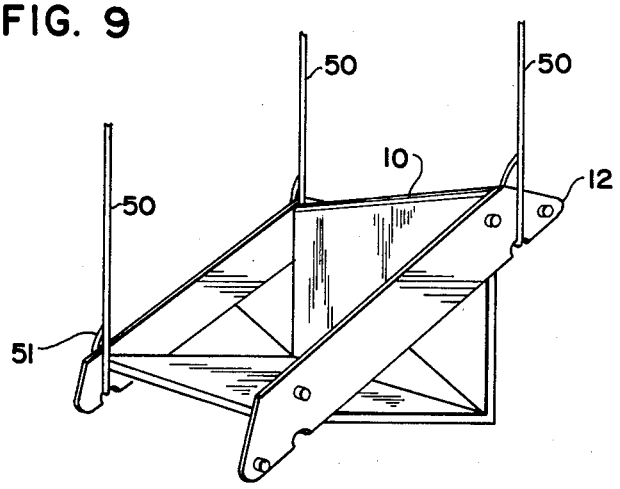
FIG. 9 is a perspective view of the seat element adapted for use as a swing.

The child's convertible furniture set of the invention comprises three elements which are interconnected in various ways to form the different configurations shown in the drawings. FIG. 1 shows, for example, the low chair position, in which a seat 10 (the first element) is fitted and placed atop a base 20 (the second element) to form a child's chair. The seat 10 and base 20 can also be connected to form a highchair (FIG. 4*b*), an angled chair (FIG. 5), or a table chair (FIG. 6). The seat 10 can be used alone to form a swing (FIG. 9). The base 20 can also be used by itself as a stepstool (FIG. 3*a*). The third element is an optional desk top (FIG. 7) which can be incorporated with the base 20 to form a desk configuration (FIG. 8). No screws, bolts or adjustment means are required; the various configurations are created solely by interlocking slots, dowel rods and dowel pins, as described below.

Figure 2:
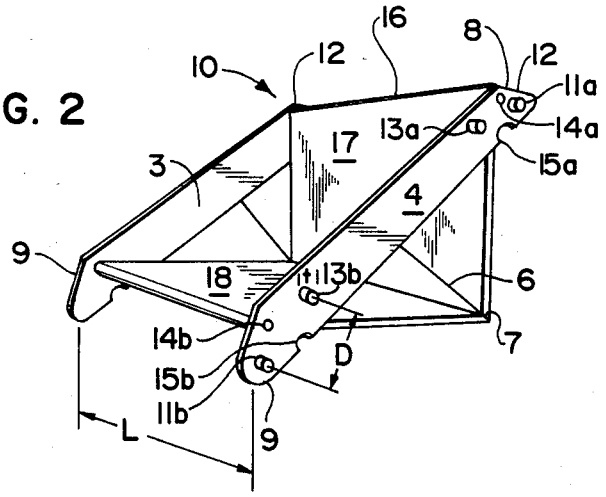
FIG. 2 is a perspective view of the seat element of FIG. 1.

Referring to FIG. 2, the seat element 10 includes two identical side slats 12 on opposite sides of a seat cushion 16. The seat cushion 16 is fixed to the side slats 12 by seat supporting rods (not shown) extending across the top end 8 and bottom end 9 of the side slats 12. The side slats 12 are maintained essentially parallel by the two seat supporting rods, which are fixed to inner surfaces 3 of the side slats by upper and lower bolts 14*a*, 14*b*, adjacent upper and lower ends 8, 9, respectively, of the side slats. The bolts are recessed into outer surfaces 4 of the side slats so as not to protrude beyond the outer surface 4 of the side slats. The seat element 10 therefore has a length L equal to the length of the slat supporting rods plus twice the thickness of a side slat 12.

The seat cushion 16 may be of any design capable of safely bearing a child's weight and preferably includes a stiff seat back 17 and stiff seat bottom 18. The seat back and bottom are stiff enough so that a child may sit on either the back 17 or bottom 18. The seat cushion 16 is preferably covered with a washable fabric or made of a washable material. This seat cushion 16 is not centered relative to side slats 12, but is disposed slightly off center in an upward direction. That is, the bolt 14*a* at the upper end 8 is located close to the top edge of the side slat 12, while the lower bolt 14*b* is located relatively further away from the lower end 9 of the side slat 12. The eccentric position of the seat cushion 16 on the side slats causes the side slats 12 to have relatively long lower ends 9 projecting below seat bottom 18, and relatively short upper ends 8 projecting above seat back 17.

The seat cushion 16 must support a child's weight at the junction 7 between the seat back 17 and seat bottom 18. Preferably, the seat back 17 and seat bottom 18 are arranged to make an angle of approximately 45° with the side slats 12, so that the junction 7 forms a right angle between the seat back 17 and bottom 18. Preferably, a steel supporting rod 6 extends perpendicularly from each side slat 12 toward the junction 7. In a preferred embodiment, a single steel supporting rod extends from one side slat 12 toward the junction 7 and then is bent at a right angle to extend across the junction 7 toward the opposite side slat 12. The steel rod is then bent at another right angle to join the opposite side slat 12. However, other embodiments are feasible such as relying on different means of support, or on seat cushion 16 alone.

Side slats 12 serve to join seat element 10 to the base element 20. To do so, the upper and lower ends 8, 9 of each side slat are provided with a pair of dowel pins: two outer dowel pins 11*a*, 11*b* adjacent the ends of the side slats, and two inner dowel pins 13*a* and 13*b*. These dowel pins are further designated as upper outer dowel pins 11*a* in the upper end 8 of the side slats, lower outer dowel pins 11*b* on the lower end 9, upper inner dowel pins 13*a*, and lower inner dowel pins 13*b*. Each pair of dowel pins is separated by a distance D. Each dowel pin projects away from the side slats for a distance t. The length of the seat element and dowel pins is therefore L+2t.

The side slats 12 are also provided with an upper semi-circular notch 15*a* and a lower semi-circular notch 15*b* located at the upper and lower ends, 8, 9 of the side slats 12. Preferably, the notches 15*a*, 15*b* are approximately centrally located between the outer and inner dowel pins.

In the embodiment shown in the figures, side slats 12 are substantially in the shape of elongated trapezoids having a base, top, and rounded corners. However, other configurations are feasible. The outer dowel pins 11*a* and 11*b* are positioned at the corners of the base, or longest side, of the trapezoids. The semicircular notches 15*a* and 15*b* are cut in the bases of side slats 12. Inner dowel pins 13*a* and 13*b* are positioned near the top of side slats 12.

The base element 20 is illustrated in FIGS. 3*a* and 3*b*. The base element 20 comprises two substantially L-shaped supporting members 22 (best seen in FIG. 3*b*), an I-shaped cross member 30 and two connecting dowel rods 28, 29. As shown in the figures, the L-shaped supporting members 22 have two legs 25, 26, joined at an elbow 49 having an angle of approximately 85°. The first leg 25 is longer than the second leg 26; otherwise they are identical. Each leg has an inner or facing surface 100 and outer surface 102. A second distance L′ is defined between the facing surfaces 100 of the leg 25, 26. The legs 25, 26 have an outer edge 104 and an inner edge 106, and a width W is defined therebetween. The width W is less than the distance D for reasons explained below.

The L-shaped supporting members 22 have rounded tips 21 at each end of the members opposite the elbow 49. The tips 21 support the base in a first or stepstool position illustrated in FIG. 3*a*. As illustrated in FIG. 3*b*, the base may be supported in a second, highchair position on the outer edge 104 of the short second legs 26 with the long first legs 25 extending upward. A third highchair position (not shown) is also available in which the base is supported on the outer edge 104 of the long first legs 25, with the shorter second legs extending upward.

Figure 4A:
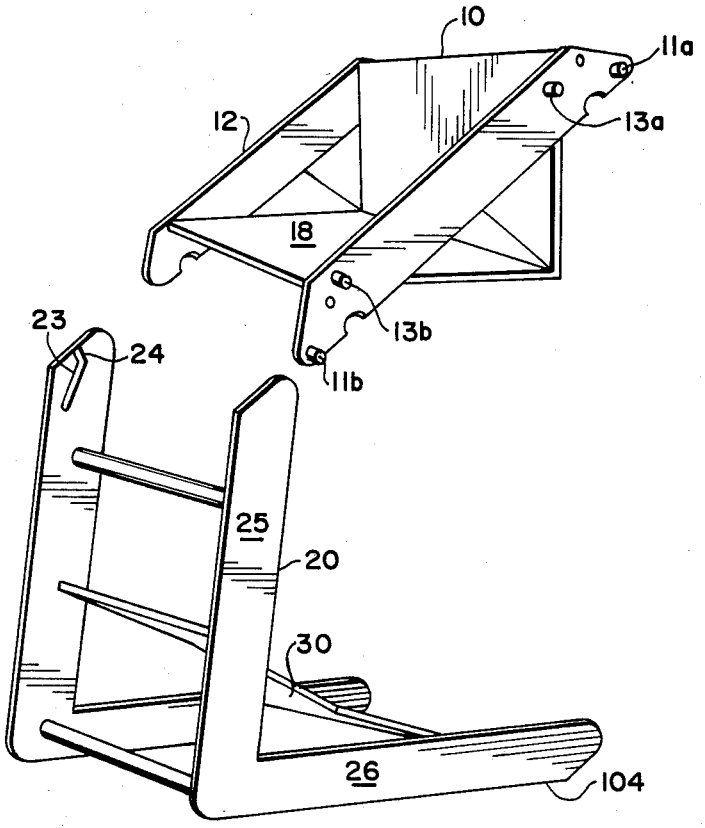
FIG. 4*a* is a view illustrating the insertion of the seat element into the base element during assembly of the tall highchair configuration.

The slight acute angle of the elbow ensures the stability of base element 20, particularly in the position illustrated in FIG. 3*b* and in the high chair configuration of FIGS. 4*a* and 4*b*. The precise angle is not significant as long as the stability of base 20 is not impaired in those configurations with a high center of gravity. The relative proportions of leg 25 to leg 26 can also be varied.

The purpose of the difference in length between the first and second legs 25, 26 is to adjust the height of the chair for different sized children. (As used herein, terms indicative of height or altitude of the furniture configurations such as "height", "level", "higher", or "lower", will mean the relative distance that the junction 7 of the seat 10 is above the surface supporting the base 20.) Therefore, the relative lengths of the first and second legs 25 and 26 may be altered as long as that versatility is not impaired. In addition, stability may be a concern if leg 25 is much longer than 26. When the first leg 25 is considerably longer than the second leg 26, stability of the base may depend on the angle at which legs 25 and 26 meet, so the two factors of length and angle should be considered together.

The I-shaped cross-member 30 comprises a first notched cross-bar section 31 with a first edge 31′ secured to a central portion of the first leg 25 and a second cross-bar section 32 with a second edge 32′ secured to a central portion of the second leg 26. The cross-bar sections 31, 32 are joined by a connecting bar 33. The second cross-bar 32 joins the second legs 26 and the first notched cross-bar 31 joins the first legs 25 at an angle such that when base 20 is in the step stool position of FIG. 3*a*, I-shaped cross-member 30 is substantially parallel to the ground. The notched cross-bar 31 includes two notches 34 formed by cutting out the outer corners of notched cross-bar 31 along the first edge 31′ at the intersections with the first legs 25. The purpose of these notches will be described below.

The first connecting dowel 28 joins the L-shaped connecting members 22 at the elbow 49 formed by the meeting of legs 25 and 26. The second connecting dowel 29 joins legs 25 at a point between the end of the first leg 25 and notched cross-bar 31. The dowel rods 28, 29 have a length at least equal to the first distance L of the seat element 10 (i.e., the length of supporting rods in the seat element plus the thickness of both side slats 12) so that the seat element can be received within the connecting members 22. That is, the second distance L' of the base is greater than the first distance L of the seat element. Preferably, the facing surfaces 100 of the legs 25, 26 are separated by the second distance L' so as to contact the outer surfaces 4 of the side slats 12 separated by the first distance L.

A slot 23 is provided on the inner side 100 of each supporting member 22, running from the inner edge 106 of each tip 21 diagonally across the inner surface of supporting member 22 toward the outer edge 104 of the supporting members 22. The slots 23 are intended to support dowel pins 11 and 13 of seat element 10, so they must be deep enough and wide enough to accommodate dowel pins 11 and 13 and slightly longer than the distance D between the outer edges of dowel pins 11 and 13. Preferably, the depth of the slots is slightly less than to the height t of the dowel pins which is preferably about one-half of the thickness of the members 22. In other words, the length of the seat element and dowel pins (L+2t) is greater than the second distance L', but less than the second distance L' plus the thickness of the members 22. In a preferred embodiment, the distances L, L' and t are chosen so that the outer surfaces 4 of the side slats 12 nearly contact the facing surfaces 100 of the legs when the seat is inserted into the base.

Slots 23 are not completely straight; each slot 23 has a bend 24 near its opening (adjacent the tip 21) to reduce the possibility of accidental dislodgement of a dowel pin (caused, for example, by a child jumping up and down in his seat) which could cause seat element 10 to separate from base element 20. The end 23' of each slot 23 permits the dowel pins to seat in the slot.

The combination of seat element 10 and base element 20 can yield any of four furniture configurations; the low chair configuration (FIG. 1), the tall highchair (FIG. 4*b*), the angled chair (FIG. 5), and the table chair (FIG. 6). Furthermore, since all of these configurations except the low chair configuration can be adjusted in height, several seating positions are possible as described below.

A. The low chair configuration

Referring to FIG. 1, the low chair configuration is formed by placing base element 20 in the stepstool configuration (FIG. 3*a*), in which tips 21 support base element 20. Seat element 10 is placed atop base element 20 adjacent the first leg 25 so that upper notch 15*a* receives first connecting dowel 28. Side slats 12 of the seat 10 are partially enclosed within legs 25 and fit into the notches 34 in notched cross-bar 31. The depth of the notch 34 permits the outer dowel pins 11*b* to contact the outer edge 104 of the first legs 25 to distribute some of the weight of seat element 10. Seat bottom 18 contacts the upper surface of I-shaped cross member 30, also distributing weight. Because of the eccentric design of seat element 10 and base 20, reversing seat element 10 and placing the lower notch 15*b* over the first connecting dowel rod 28 will not yield a stable configuration since the seat top 17 will contact the cross member 30 and prevent secure engagement of the lower notch 15*b* with the first dowel 28. Similarly, placing seat element 10 on the base 20 adjacent the second short leg 26, will not yield a stable configuration.

The notches 34 in the cross-bar 31 may be eliminated if the first edge of the cross-bar 31 is moved rearwardly away from the outer edge 104 of the first leg 25 by an amount sufficient to permit the outer dowel pins 11*b* to contact the outer edge 104. Alternatively, the position of the outer dowel pins 11*b* may be moved closer to the base of the side slats 12 to eliminate the need for the notches 34.

B. The highchair configuration

The tall highchair configuration is shown in a first configuration in FIGS. 4*a* and 4*b*. It is formed by first turning base element 20 so that the second, short legs 26 are on a supporting surface, supporting base element 20 on their outer edges 104. In this position, I-shaped cross-member 30 is at approximately a 50° angle to the ground, and legs 25, which are longer than legs 26, project upwards at approximately 85°. Seat element 10 is then positioned as shown in FIG. 4*a*, with lower outer dowel pins 11*b* aligned with the slots 23 in tips 21. Side slats 12 fit within tips 21 of legs 25 due to the relationship between the lengths of the seat element and base. Dowel pins 11*b* are placed in slots 23, directed past bends 24 and down the slots 23 until lower inner dowel pins 13*b* enter the opening of the slots 23. Dowel pins 13*b* are also guided past bends 24, at which point outer lower dowel pins 11*b* seat against the bottoms 23' of slots 23 and seat element 10 is firmly fixed to base element 20 (FIG. 4*b*). A child then sits on seat bottom 18. As noted above, the length of the slot 23 is greater than the distance D between the dowel pins. No further adjustment is necessary, and to disassemble the highchair the steps are simply reversed.

Because of the eccentric design of seat element 10, the tall highchair configuration has a second configuration (not shown). If seat element 10 is reversed so that upper outer dowel pins 11*a* are introduced into slots 23 followed by upper inner dowel pins 13*a*, a second highchair having a slightly lower height, for a slightly taller child, will result. In this position, a child sits on the seat back 17.

The tall highchair configuration is still further adjustable to a short highchair configuration. The short highchair configuration (not shown in the figures) results from placing the outer edge 104 of the first legs 25 on a supporting surface instead of the second legs 26. Since the second legs 26 are shorter than the first legs 25, they will project upwards to a lesser degree than first legs 25. When seat element 10 is in place with the lower dowel pins 11*b*, 13*b* in the slot 23, (as described above for the tall highchair configuration), the result will be a third, still shorter highchair configuration. If seat element 10 is reversed such that the upper dowel pins 11*a*, 13*a* are received in the slot 23, a fourth highchair will result which is shorter than the third highchair.

C. The angled chair

FIG. 5 illustrates the angled chair configuration. The angled chair depicted in FIG. 5 is adjustable for two slightly different heights. In the position shown, the outer edge 104 of the first legs 25 are placed on the supporting surface, with legs 26 projecting upwards. Since the width W of the second legs 26 is slightly narrower than the distance D between the upper dowel pins 11*a* and 13*a*, the tips 21 of the second legs 26 can pass through the distance D between the dowel pins so that seat element 10 slides down legs 26. The junction 7 of the seat 10 will contact the I-shaped cross-member 30, and slide down the cross-member until the base of the side slats 12 contact the second edge 32' of cross bar 32. In this configuration, the cross-member 30 is at an angle so that the junction 7 slides down the cross member and moves away from the second leg 26. This causes the seat back 17 and seat bottom 18 to be angled relative to the horizontal. Seat element 10 will thus be secured by dowel pins 11*a* and 13*a* and legs 26, and will rest on I-shaped cross-member 30 at two points: the first edge 32' of cross-bar 32 and the approximate center of connecting bar 33.

To obtain the second position of this configuration, seat element 10 is simply reversed so that legs 26 pass between the distance D formed by the lower dowel pins 11*b* and 13*b*. However, unlike the highchair configuration of FIGS. 4*a* and 4*b*, reversing base element 20 so that legs 25 project upwards will not permit additional height adjustments because the second connecting dowel 29 will not permit seat element 10 to make proper, stable contact with I-shaped cross-member 30.

D. The table chair configuration

FIG. 6 illustrates the table chair configuration, which has four different positions. Base element 20 is positioned with the first legs 25 horizontally located, and legs 26 projecting upwards. To secure seat element 10, upper outer dowel pins 11*a* are inserted in slots 23 and seated at the bottoms of slots 23. The upper inner dowel pins 13*a* are not inserted within the slot 23, but remain at a distance from the inner edge 106 of the second leg 26. When the upper outer dowel pins become seated at the base of the slot 23, the junction 7 will contact the I-shaped cross-member 30 at connecting bar 33. However, unlike the angled chair configuration, the seat back 17 remains approximately vertical while the seat bottom is generally horizontal. The weight of seat element 10 will be distributed to the connecting bar 33 through the junction 7, and the second legs 26 through dowel pins 11*a*.

The second table chair position (not shown) is achieved in the same manner, except that upper inner dowel pins 13*a* are inserted in slots 23. The upper outer dowel pins 11*a* are not inserted in the slot but are spaced from the outer edge 104 of the leg 26. Again, the junction 7 contacts the connecting bar 33 to transfer the weight of seat element 10 to connecting bar 33, and dowel pins 13*a* transfer weight to the second legs 26. The third position entails simply reversing seat element 10 and inserting lower outer dowel pins 11*b* in slots 23 instead of upper outer dowel pins 11*a*. Otherwise, assembly is identical. The fourth position also entails reversing seat element 10, but in this case, lower inner dowel pins 13*b* are inserted in slots 23.

It is noted that an additional four similar chair position are possible if the base 20 is inverted such that the base 20 rests on the second legs 26 with the first legs 25 projecting upward. However, these configurations are not recommended, since the seat back or slat bottom may contact the second dowel 29 and prevent contact between the junction 7 and the cross member 30.

E. The writing desk configuration

The third element of the invention, desk element 40, is shown in FIGS. 7*a* and 7*b*. Desk element 40 comprises a preferably rectangular desk top 42, two triangular supports 44, and a retaining peg 46. The desk top preferably includes two long longitudinal sides X and two shorter transverse sides Y. Triangular supports 44 are positioned on the under surface 110 or underside of desk top 42 parallel to the short sides Y of desk top 42 so that the distance between their outer surfaces is slightly less than the distance between the inner surfaces of L-shaped supporting members 22. Triangular supports 44 are also approximately centered with respect to the short sides of desk top 42.

By itself, desk top 42 may be used as a lap desk, with supports 44 straddling the user's lap. Outward leg pressure against supports 44 holds the desk top in position on the user's lap.

Retaining peg 46 is centrally positioned on the underside of desk top 42. A semi-circular post retaining notch 47 is cut into the retaining peg 46. The radius of notch 47 equals that of the elbow connecting dowel 28. Upper and lower dowel pins 43 and 45 protrude from the outer surfaces of triangular supports 44 along the edges of triangular supports 44 nearest retaining peg 46.

FIG. 7*b* depicts the desk element 40 being fitted atop base element 20. To achieve this configuration, base element 20 is placed in the stepstool configuration of FIG. 3*a*. Desk element 40 is positioned so that the lower points of triangular supports 44 are within the inner surfaces of the second legs 26. Dowel pins 45 contact the outer edges of the legs 26 and the desk element 40 is lowered until dowel pins 43 also contact the edges of legs 26. Retaining notch 47 of the peg 46 will then meet and interlock with the first connecting dowel 28, and the underside of desk top 42 will now rest on the elbows 49 of L-shaped connecting member 22. In this configuration, the desk top 42 is parallel to the cross-bar 31 which in turn is parallel to the surface supporting the base. This will yield a stable desk/chair combination illustrated in FIG. 8, in which notched cross-bar 31 forms the seat, with space on either side of connecting bar 33 for the child's legs. The child enters the desk by sitting between the first legs 25.

Desk top 40 may be fitted onto the base element 20 in several other positions (not shown) to form a standing desk and a music stand. These additional positions are possible because pins 43 and 45 on supports 44 of the desk top are identical in size and spacing to pins 11 and 13 on the side slats 12. In the standing desk and music stand configurations, the base 20 is positioned in the high chair position of FIG. 3*b* and the pins 43 and 45 of the desk top are received in the slots 23 of one of the first and second legs 25, 26.

F. The swing configuration

Referring to FIG. 9, there is depicted the swing configuration. In this configuration, the seat element 10 is separated from the base 20 and suspended by ropes. For example, loops 51 on ropes 50 are slipped over the ends of side slats 12 and received into notches 15*a*, *b* of each side slot 12 (for clarity, a rope 10 not shown is connected to one of the lower notches 15*b*). The free ends of ropes 50 can be attached to an overhead bar, framework or other suitable means of support permitting seat element 10 to hang and swing freely.

G. The stepstool configuration

The base 20 can also be used by itself as a stepstool. In FIG. 3*a*, the base is supported on its tips 21 such that the cross-member 30 is generally horizontal and spaced above the tips 21. In this position, a child can step upward onto the cross-member 30, thereby using the base as a stepstool.

The base, side slats for the seat, and desk top are preferably made of wood, but other materials are possible.

The convertible furniture set in accordance with the present invention provides for the simple conversion from one position to another. The conversion does not require tools, but only repositioning of the furniture elements. In addition, the furniture set is relatively inexpensive and has an esthetically pleasing appearance.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

I claim:

1. A child's convertible furniture set capable of conversion to a low chair and a highchair, said furniture set comprising:

a seat element having two side slats with inner and outer surfaces, said side slats being separated by a first distance with said seat element secured between the inner surfaces thereof, said seat element having a seat back connected to an upper end of said slats and a seat bottom connected to a lower end of said slats, said seat back and seat bottom intersecting at a junction spaced from said side slats;

a base adapted to detachably receive and support said seat element; said base having two L-shaped members defining first and second legs intersecting at an elbow, a first dowel extending between the elbows of said L-shaped members, and a cross-member having a first edge connected to a central portion of said first legs and an opposite second edge connected to a central portion of said second legs; said L-shaped members having facing surfaces separated by a second distance greater than said first distance separating said side slats of said seat element; said first and second members defining an outer edge and an inner edge with a first width therebetween, and having a tip at an end of each leg opposite from said elbow such that said base is supportable in one of a first position on said tips of said first and second legs and a second position on the outer edge of said second legs with said first legs extending generally upward; and means for detachably securing said seat element to said base, said means comprising upper and lower pairs of pins each located on the outer surfaces of the upper and lower ends of said side slats, respectively, said upper and lower pairs of pins each having an inner pin and an outer pin separated by a second width greater than said first width of said first and second legs, upper notches located in said side slats approximately centrally between said inner and outer pins of said upper pair of pins, said notches having a size sufficient to receive said first dowel, first slots located in the facing surfaces of the tips of said first legs of said base, each of said first slots being adapted to receive at least one of said inner and outer pins of said upper and lower pairs of pins and having a length greater than said second width between said pins, wherein said seat element is secured to said base in said first position to form the low chair in which said upper notches of said side slats receive said first dowel, and said side slats fit between said first legs to permit said outer pin of said lower pair of pins to contact said outer edge of said first leg, and said seat element is secured to said base in said second position to form the highchair in which one of said upper and lower pairs of pins is received within said slots of said first legs.

2. The child's convertible furniture set of claim 1, wherein the distance between said upper end of said side slat and said seat back is less than the distance between said lower end of said side slat and said seat bottom, such that said high chair has two configurations, a first configuration in which the upper pair of pins are received in said first slots and a second configuration in which the lower pair of pins are received in said first slot, said second highchair configuration being higher than said first highchair configuration.

3. The child's convertible furniture set of claim 2, wherein said first legs are longer than said second legs, said base is supportable in a third position on the outer edge of said first legs with said second legs extending generally upward, and second slots are located in said facing surfaces of said tips of said second legs and have a length greater than said second width between said pins, such that said seat element is secured to said base in the third position to form a short highchair which is lower than said highchair formed with said base in said second position, said shorter highchair having one of said upper and lower pairs of pins received within said second slots to secure said seat element to said base.

4. The child's convertible furniture set of claim 3, wherein said short highchair has two configurations, a first configuration in which said upper pair of pins is received within said second slot, and a second configuration in which said lower pair of pins is received within said second slot, said second configuration being higher than said first configuration.

5. The child's convertible furniture set of claim 3, wherein said set is capable of conversion to a first angled chair in which said base is in the third position with said second legs extending upward, said tips of said second legs being received between said inner and outer pins of said upper pairs of pins, said junction of said seat contacting said cross-member, and said upper ends of said side slats abutting said second edge of said cross-member.

6. The child's convertible furniture set of claim 5, wherein said set is capable of conversion to a second angled chair in which said base is in the third position and said tips of said second legs are received between the inner and outer pins of said lower pairs of pins, said junction of said seat contacting said cross-member, and said lower ends of said side slats abutting said second edge of said cross-member, said second angled chair being lower than said first angled chair.

7. The child's convertible furniture set of claim 3, wherein said set is capable of conversion to a table chair in which said base is in said third position with said second legs extending generally upward, and one of said inner and outer pins of one of said upper and lower pairs of pins is received within said second slot, said junction of said seat element contacting said cross-member.

8. The child's convertible furniture set of claim 7, wherein a first level table chair is defined with said outer pins of said lower pair of pins in said second slot.

9. The child's convertible furniture set of claim 8, wherein a second level table chair is defined with said inner pins of said lower pair of pins in said second slot, said second level table chair being higher than said first level table chair.

10. The child's convertible furniture set of claim 9, wherein a third level table chair is defined with said outer pins of said upper pair of pins in said second slot.

11. The child's convertible furniture set of claim 10, wherein a fourth level table chair is defined with said inner pins of said upper pair of pins in said second slot.

12. The child's convertible furniture set of claim 1, wherein said cross-member is in a generally horizontal plane above said tips when said base is in said first position, said base in said first position with said seat element detached therefrom forming a stepstool.

13. The child's convertible furniture set of claim 1, further comprising means for suspending said seat element when said seat element is detached from said base, and lower notches located in said side slats approximately centrally between said inner and outer pins of said lower pair of pins, said seat element forming a swing with said means for suspending being attached to said upper and lower notches of said side slots.

14. The child's convertible furniture set of claim 1 capable of further conversion to a desk, and further comprising:

a desk top having an upper surface and an undersurface, a pair of depending flanges attached to a central area of said undersurface and separated by the first distance, and a depending post attached to said undersurface adjacent an edge thereof, and means for detachably securing said desk top to said base in said first position with said seat element detached therefrom, said means comprising a pair of flange pins projecting from said depending flanges for engagement with said outer edge of said second legs, and a post notch in said depending post for reception of said first dowel whereby said desk top is attached to said base in said first position with said first dowel received in said post notch and said flange pins in contact with said outer edge of said second legs so that said undersurface of said desk top contacts said elbows and said desk top is located in a generally horizontal plane.

15. The child's convertible furniture set of claim 14, wherein said cross-member is a seat for said desk.

16. The child's convertible furniture set of claim 14, wherein said flange pins of said desk top are generally identical in size and spacing to said upper and lower pair of pins on said side slats of said seat element, said flange pins being received in said first slots of said base in said second position to form a standing desk.

17. The child's convertible furniture set of claim 1, wherein said elbow forms an angle between said first and second legs of about 85°.

18. The child's convertible furniture set of claim 1, wherein said slot has a depth slightly less than the height of said pins.

19. The child's convertible furniture set of claim 1, wherein said means for detachably securing said seat element to said base further includes corner notches located at intersections of said first edge of said cross member and said first legs of said base, said coroner notches having a size sufficient to receive said side slats to form the low chair, the size of the notches permitting said outer pin of said lower pair of pins to contact said outer edge of said first leg.

* * * * *